US009629219B1

(12) United States Patent
Nguyen et al.

(10) Patent No.: US 9,629,219 B1
(45) Date of Patent: Apr. 18, 2017

(54) METHODS AND APPARATUS OF INCANDESCENT BULB EMULATOR

(71) Applicant: GE Lighting Solutions, LLC, East Cleveland, OH (US)

(72) Inventors: Nam N S Nguyen, Lachine (CA); Christian Poirier, Lachine (CA)

(73) Assignee: GE LIGHTING SOLUTIONS, LLC, East Cleveland, OH (US)

( * ) Notice: Subject to any disclaimer, the term of this patent is extended or adjusted under 35 U.S.C. 154(b) by 0 days.

(21) Appl. No.: 15/009,022

(22) Filed: Jan. 28, 2016

(51) Int. Cl.
*H05B 33/08* (2006.01)

(52) U.S. Cl.
CPC ..... *H05B 33/089* (2013.01); *H05B 33/0815* (2013.01); *H05B 33/0851* (2013.01)

(58) Field of Classification Search
USPC ..... 315/160
See application file for complete search history.

(56) References Cited

U.S. PATENT DOCUMENTS 6,762,563 B2 7/2004 St-Germain et al.
7,795,820 B2 9/2010 Housman

FOREIGN PATENT DOCUMENTS

WO WO2013045867 A1 4/2013

*Primary Examiner* — Douglas W Owens
*Assistant Examiner* — Jianzi Chen
(74) *Attorney, Agent, or Firm* — GE Global Patent Operation; Peter T. DiMauro

(57) ABSTRACT

Provided is a method for controlling operation of an incandescent bulb emulator. The method includes converting, via a converter, an input voltage to a predetermined DC voltage, and driving an LED load based upon the predetermined DC voltage. In certain embodiments, input voltage may include an AC input voltage and a DC input voltage. The method also compares, via a controller, an input current curve of the incandescent bulb emulator with an input current curve of a simulated incandescent bulb responsive to the driven LED load. A DC driving current through the LED load is adjusted based upon the comparing. Amount of power delivered to LED load may be limited through an EMI filter having a magnetic design to match input current characteristics of incandescent bulb. The adjustment continues such that input current curve of incandescent bulb emulator matches the input current curve of the simulated incandescent light bulb.

20 Claims, 2 Drawing Sheets

200

METHODS AND APPARATUS OF INCANDESCENT BULB EMULATOR

FIELD OF THE INVENTION

The present disclosure relates to lighting systems. More particularly, the present disclosure relates to light emitting diodes (LEDs) used in systems configured for incandescent light bulbs.

BACKGROUND OF THE INVENTION

In rail wayside signal systems, incandescent light bulbs are widely used as light sources for signaling. The signaling system using incandescent light bulbs is very simple to operate and control. The incandescent light bulbs are mostly resistive loads. Therefore, the current traveling through the incandescent light bulbs is directly proportional to the input voltage. Additionally, the lighting intensity level is directly proportional to the bulbs input voltage.

With advancement in the semiconductor fields and commercialization of LEDs, applications of LEDs as replacements for incandescent light bulbs have now become a reality. Early LEDs were often used as indicator lamps for electronic devices, replacing small incandescent bulbs. They were soon packaged into numeric readouts in the form of seven-segment displays, and were commonly seen, for example, in digital clocks.

Recent developments in LEDs permit them to be used in environmental and task lighting. LEDs have many advantages over incandescent light sources including lower energy consumption, longer lifetime, improved physical robustness, smaller size, and faster switching. LEDs are now used in applications as diverse as aviation lighting, automotive headlamps, advertising, general lighting, traffic signals, camera flashes and even LED wallpaper.

One of the characteristics of the incandescent light bulbs is the almost linear relationship between the input voltage and the input current. Traditionally, the rail wayside signal system is designed to perform its signaling tasks with this linear relationship between voltage and current. LEDs do not exhibit linear relationships. Therefore, if LEDs were to be used to replace the incandescent light bulbs in existing signal systems, either the rail wayside signal system or the LEDs must be changed to ensure the safety and reliability of the rail wayside signal system.

Therefore, heretofore unaddressed needs still exist in the art to address the aforementioned deficiencies and inadequacies.

SUMMARY OF THE EMBODIMENTS

Given the aforementioned deficiencies, a need exists for LEDs to replace the conventional incandescent bulb, where the LEDs exhibit electronic characteristics similar to the incandescent bulb.

Under certain circumstances, embodiments of the present invention provide a method for controlling operation of an incandescent bulb emulator. In certain embodiments, the incandescent bulb emulator has a controller, an incandescent bulb simulator module, and an LED load. The method includes: converting, via a converter, an input voltage to a predetermined DC voltage, driving the LED load based upon the predetermined DC voltage, comparing, via the controller, an input current curve of the incandescent bulb emulator with an input current curve of a simulated incandescent bulb responsive to the driven LED load, and adjusting a DC driving current to the LED load, based upon the comparing, such that the input current curve of the incandescent bulb emulator matches the input current curve of the simulated incandescent light bulb. The input voltage may include an AC input voltage, and a DC input voltage.

In certain embodiments, the converter has an input voltage converter, and an auxiliary supply. The DC driving current through the LED load is directly proportional to the input voltage of the incandescent bulb emulator. As the input voltage fluctuates, the DC driving current through the LED load is adjusted so that the light intensity level of the LED load matches the light intensity level of an incandescent bulb to be replaced by the LED load.

These and other aspects of the present disclosure will become apparent from following description of the embodiments taken in conjunction with the following drawings and their captions, although variations and modification therein may be affected without departing from the spirit and scope of the novel concepts of the disclosure.

BRIEF DESCRIPTION OF THE DRAWINGS

The present disclosure is illustrated in the accompanying drawings, throughout which, like reference numerals may indicate corresponding or similar parts in the various figures. The drawings are only for purposes of illustrating preferred embodiments and are not to be construed as limiting the invention. Given the following enabling description of the drawings, the novel aspects of the present disclosure should become evident to a person of ordinary skill in the art.

DETAILED DESCRIPTION

Figure 1:
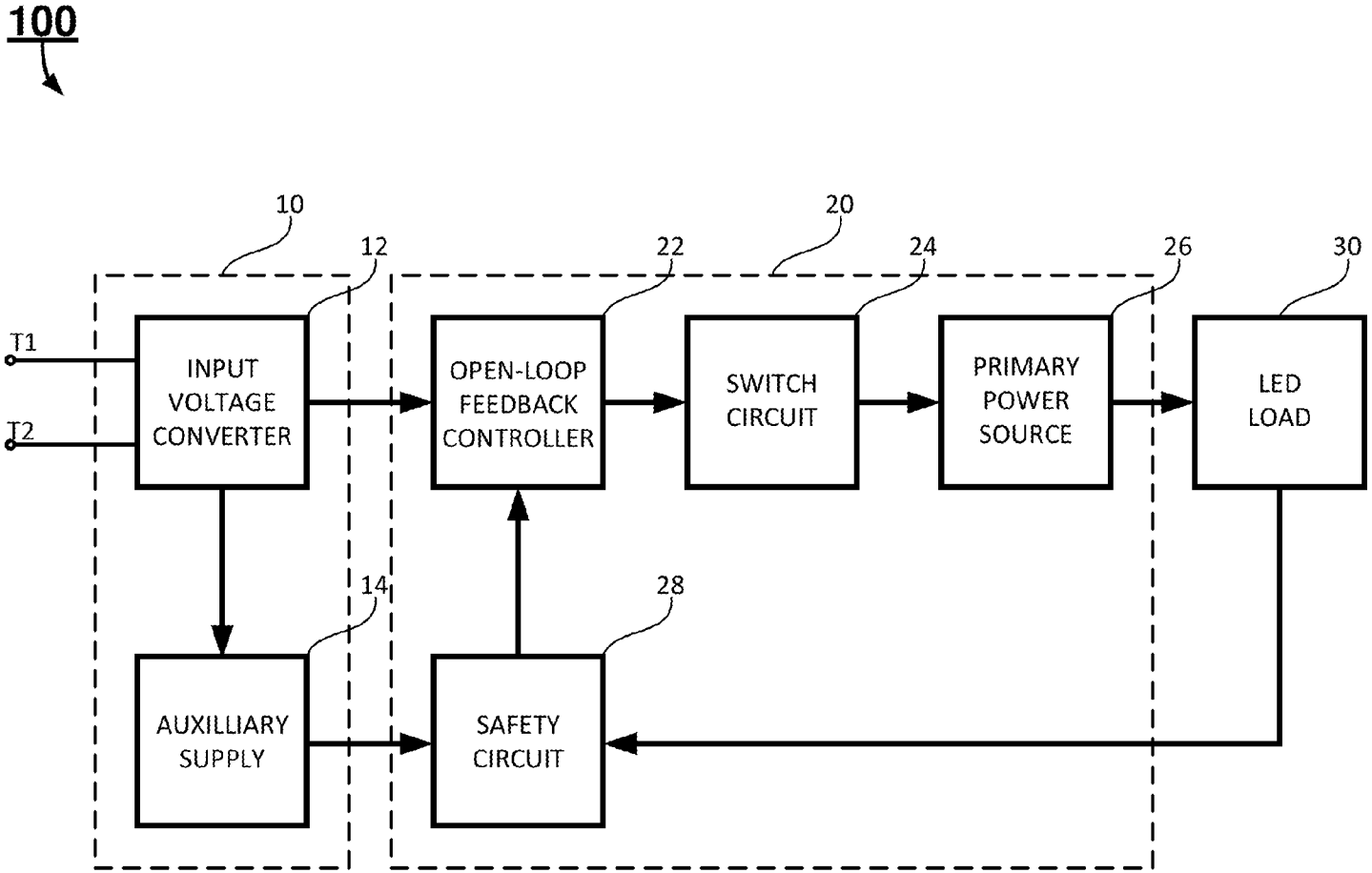
FIG. 1 is a block diagram of an incandescent bulb emulator in accordance with certain embodiments of the present invention.

While the present invention is described herein with illustrative embodiments for particular applications, it should be understood that the invention is not limited thereto. Those skilled in the art with access to the teachings provided herein will recognize additional modifications, applications, and embodiments within the scope thereof and additional fields in which the invention would be of significant utility.

Unless defined otherwise, technical and scientific terms used herein have the same meaning as is commonly understood by one of ordinary skill in the art to which this invention belongs. The terms "first," "second," and the like, as used herein do not denote any order, quantity, or importance, but rather are used to distinguish one element from another. Also, the terms "a" and "an" do not denote a limitation of quantity, but rather denote the presence of at least one of the referenced items. The term "or" is meant to be inclusive and mean either, any, several, or all of the listed items.

The use of "including," "comprising," or "having" and variations thereof herein are meant to encompass the items listed thereafter and equivalents thereof as well as additional items. The terms "connected" and "coupled" are not restricted to physical or mechanical connections or couplings, and can include electrical connections or couplings, whether direct or indirect. The terms "circuit," "circuitry," and "controller" may include either a single component or a plurality of components, which are either active and/or passive components and may be optionally connected or otherwise coupled together to provide the described function.

The following description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims.

For purposes of clarity, the same reference numbers will be used in the drawings to identify similar elements. As used herein, the phrase at least one of A, B, and C should be construed to mean a logical (A or B or C), using a non-exclusive logical OR. It should be understood that one or more steps within a method may be executed in different order (or concurrently) without altering the principles of the present disclosure.

The controller can be configured to control operation of the switch elements—activating (turning on) and deactivating (turning off) power switches within the switch elements, one at a time. Activating and deactivating the power switches enables precise control of the voltage from a converter.

In the embodiments, converters are utilized in applications requiring direct conversion of electrical energy from AC to DC, or DC to DC.

LEDs can be used in rail wayside signal systems. In these wayside signal systems, the LEDs may include one or more LED light sources, or an LED array having multiple LEDs to form an LED load.

In one aspect, embodiments of the present invention include an incandescent bulb emulator 100. The incandescent bulb emulator 100 includes an LED load 30, a converter 10, and a controller 20.

The LED load 30 can replace an incandescent bulb to serve as a lighting source. In one embodiment, the LED load 30 is an actual LED. In another embodiment, the LED load 30 is an LED array including multiple LEDs connected together. The LED load 30 also includes an incandescent bulb simulator module, and a resistive load. The incandescent bulb simulator module is used to simulate the input current curve of the simulated incandescent light bulb and provide an input current curve reference for the incandescent bulb emulator 100. The resistive load is used to increase the input current consumption to match the input current consumption of the incandescent bulb emulator 100 with the input current consumption of the incandescent bulb to be replaced by the LED load 30 across an operating voltage range.

In the embodiments, the controller 20 is an LED driving controller. The LED driving controller has an open loop feedback controller 22, a switching circuit 24, a primary power source 26, and a safety circuit 28. The open loop feedback controller 22 receives open loop feedback from the safety circuit 28, controls the DC driving current through the LED load 30, and drives the LED load 30 through the primary power source 26. The switching circuit 24 provides switch control to the incandescent bulb emulator 100 according to the AC input voltage and a failure mode of the LED load 30.

In certain embodiments, the open loop feedback controller 22 may include an electromagnetic interference (EMI) filter. The EMI filter is configured to limit the amount of power that can be delivered to output load including LED and resistive load, through limiting a magnetic design to match the input current characteristic of the incandescent bulb. In one embodiment, the magnetic is designed to deliver a predetermined amount of power to the output starting at a fixed voltage V1. For any voltage below that (i.e. $v<V1$), the magnetic may not limit the amount of power delivered to the output, where this amount of power delivered to the output directly proportional to the input voltage. The higher the input voltage, the higher the output power, hence the higher input current, and vice versa.

The primary power source 26 receives the DC driving current from the open loop feedback controller 22, and provides DC driving current through the LED load 30. The safety circuit 28 monitors the output power consumption of the incandescent bulb emulator 100, detects a failure mode of the LED load 30 when the LED load 30 fails, and sends signal to the switching circuit 24 to shut off the DC driving current through the LED load 30.

In the embodiment of FIG. 1, the converter 10 includes an input voltage converter 12, and an auxiliary supply 14. The converter 10 receives an input voltage from a pair of input terminals: a first terminal (T1) and a second terminal (T2). The converter 10 converts the input voltage to a predetermined DC voltage, and provides the DC driving current through the LED load 30 through the primary power source 26. The auxiliary supply 14 receives the predetermined DC voltage from the input voltage converter 12 and provides the predetermined DC voltage to the safety circuit 28 as its DC power supply. In one embodiment, the input voltage converter 12 is a full bridge rectifier.

The controller 20 compares the input current curve of the incandescent bulb emulator 100 with an input current curve of a simulated incandescent bulb using the incandescent bulb simulator module. The simulated incandescent bulb is responsive to the driven LED load. As the input voltage fluctuates, the open loop feedback controller 22 adjusts a DC driving current through the LED load 30, based upon the comparing. This process continues until the input current curve of the incandescent bulb emulator 100 matches the input current curve of the simulated incandescent light bulb.

The DC driving current through the LED load 30 is directly proportional to the input voltage of the incandescent bulb emulator 100. The DC driving current through the LED load 30 is adjusted by the open loop feedback controller 22 so that the light intensity level of the LED load 30 matches the light intensity level of the incandescent bulb to be replaced by the LED load 30.

The open loop feedback controller 22 includes a current comparator (not shown). The current comparator compares the input current curve of the incandescent bulb emulator 100 with the input current curve of the simulated incandescent bulb responsive to the driven LED load. When the input current curve of the incandescent bulb emulator 100 closely follows the input current curve of the simulated incandescent bulb, the output of the current comparator is small, and will not create the need for adjustments to the DC driving current.

When the difference between the input current curve of the incandescent bulb emulator 100 and the input current curve of the simulated incandescent bulb is greater than a predetermined threshold, the output of the current comparator will create the need for certain adjustments to the DC driving current. These adjustments minimize the difference between the input current curve of the incandescent bulb emulator 100 and the input current curve of the simulated incandescent bulb.

The open loop feedback controller 22 also includes an electromagnetic interference (EMI) filter and a fuse. When the LED load 30 is in failure mode, the safety circuit 28 sends signal to the open loop feedback controller 22 to switch off the primary power source 26.

Figure 2:
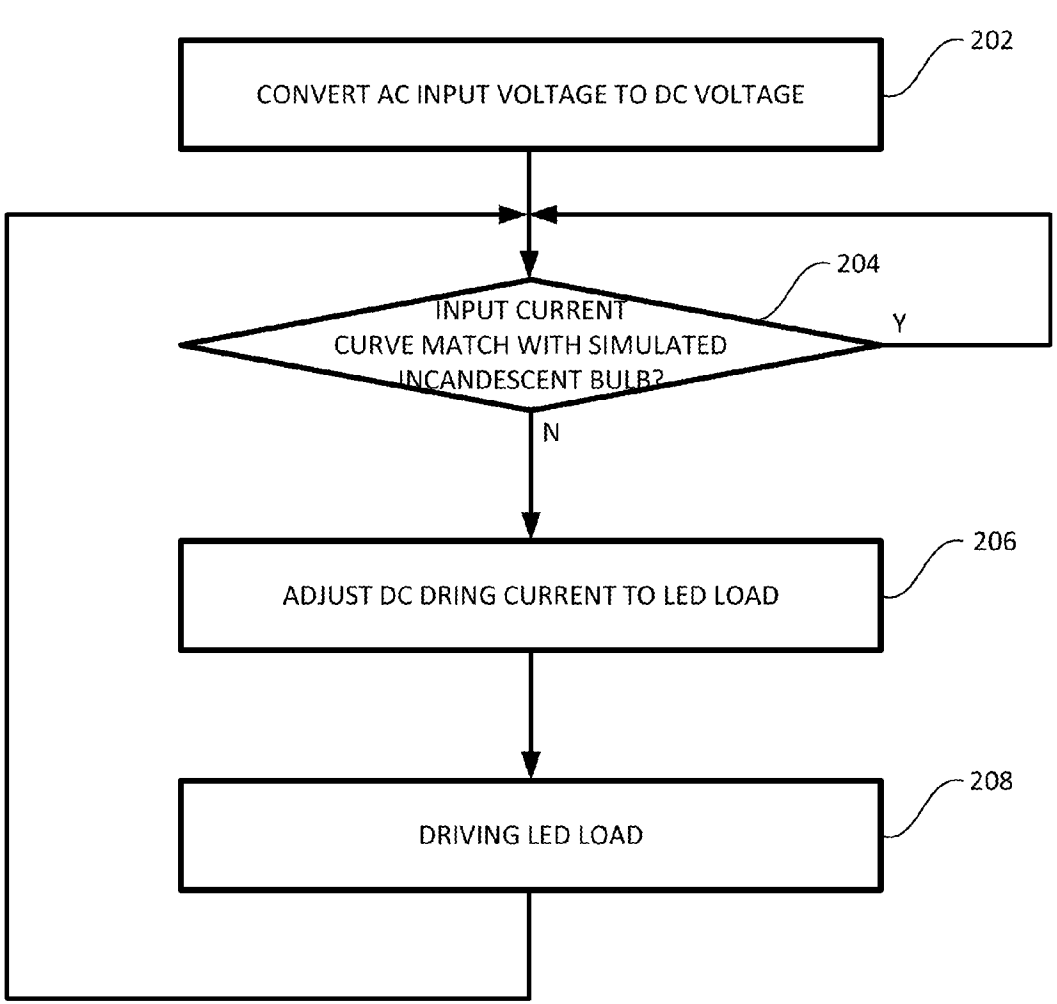
FIG. 2 is a flowchart of the incandescent bulb emulator in accordance with certain embodiments of the present invention.

In another aspect, the present invention relates to a method 200 for controlling operation of the incandescent bulb emulator 100 as described above. Referring to FIG. 2, a flowchart of the incandescent bulb emulator 100 is shown in accordance with certain embodiments of the present invention. The method 200 is provided for controlling a DC driving current through the LED load 30 through the primary power source 26 such that the incandescent bulb emulator 100 exhibits similar electronic characteristics to the incandescent bulb to be replaced by the LED load 30.

For ease of description, one or more steps or operations included in method 200 are grouped in blocks. Nevertheless, one of ordinary skill in the art will readily understand that operations described in each block may be performed independently, sequentially, or asynchronously, without departing from the spirit and scope of the present invention.

Method 200 includes a first operation 202 that includes converting an input voltage to a predetermined DC voltage. In certain embodiments, the input voltage may include an AC input voltage, and a DC input voltage. When the input voltage is the AC input voltage, the the converter 10 may convert the DC input voltage to the predetermined DC voltage in a different voltage that is required by the incandescent bulb emulator 100. When the input voltage is the AC input voltage, the input voltage converter 12 of the converter 10 receives the AC input voltage from the first terminal T1 and the second terminal T2, converts the AC input voltage to the predetermined DC voltage, and provides the DC driving current to the controller 20. The auxiliary supply 14 receives the predetermined DC voltage from the input voltage converter 12 and provides the predetermined DC voltage to the safety circuit 28 as its DC power supply. In certain embodiments, the input voltage converter 12 is a full bridge rectifier.

Method 200 includes a second operation 204 that includes matching the input current curve of the incandescent bulb emulator 100 with the input current curve of the simulated incandescent bulb using the incandescent bulb simulator module. The current comparator is used to match the input current curve of the incandescent bulb emulator 100 with the input current curve of the simulated incandescent bulb.

When the input current curve of the incandescent bulb emulator 100 closely follows the input current curve of the simulated incandescent bulb, the output of the current comparator is small, therefore, no adjustment is necessary. The operation loops back to operation 204. When the difference between the input current curve of the incandescent bulb emulator 100 and the input current curve of the simulated incandescent bulb is greater than a predetermined threshold, certain adjustments to the DC driving current are necessary. These adjustments reduce the difference between the input current curve of the incandescent bulb emulator 100 and the input current curve of the simulated incandescent bulb. The operation proceeds to operation 206.

A third operation 206 includes adjusting the DC driving current through the LED load 30 through the primary power source 26. Based upon the comparison from the operation 204, the DC driving current through the LED load is adjusted such that the input current curve of the incandescent bulb emulator 100 matches the input current curve of the simulated incandescent light bulb.

The operation 206 can also include switching off the primary power supply 26 to the LED load 30 using the switching circuit 24. The open loop feedback controller 22 receives open loop feedback from the safety circuit 28, controls the DC driving current through the LED load 30, and drives the LED load 30 through the primary power source 26.

The switching circuit 24 provides switch control to the incandescent bulb emulator 100 according to the AC input voltage and a failure mode of the LED load 30. The safety circuit 28 monitors the output power consumption of the incandescent bulb emulator 100, detects a failure mode of the LED load 30 when the LED load 30 fails, and sends signal to the switching circuit 24 to shut off the DC driving current through the LED load 30.

An operation 208 includes driving the LED load 30 through the primary power source 26. In certain embodiments, the DC driving current from the primary power source 26 is directly proportional to the input voltage of the incandescent bulb emulator 100. As the AC input voltage fluctuates, the DC driving current through the LED load 30 is adjusted so that the light intensity level of the LED load 30 matches the light intensity level of the incandescent bulb to be replaced by the LED load 30. In the embodiments, the LED load 30 includes a resistive load to increase the input current consumption. The input current consumption is increased to desirably match the input current consumption of the incandescent bulb emulator 100 with the input current consumption of the incandescent bulb to be replaced by the LED load 30 across an operating voltage range.

CONCLUSION

The foregoing description of the exemplary embodiments of the disclosure has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present disclosure pertains without departing from its spirit and scope. For example, multiple probes may be utilized at the same time to practice the present disclosure. Accordingly, the scope of the present disclosure is defined by the appended claims rather than the foregoing description and the exemplary embodiments described therein.

What is claimed is:

1. A method for controlling operation of an incandescent bulb emulator having a controller, an incandescent bulb simulator module, and a light emitting diode (LED) load, the method comprising:

converting, via a converter, an input voltage to a predetermined direct current (DC) voltage, wherein the input voltage comprises an alternate current (AC) input voltage, and a DC voltage;

driving the LED load based upon the predetermined DC voltage;

comparing, via the controller, an input current curve of the incandescent bulb emulator with an input current curve of a simulated incandescent bulb responsive to the driven LED load; and adjusting a DC driving current to the LED load, based upon the comparing, such that the input current curve of the incandescent bulb emulator matches the input current curve of the simulated incandescent light bulb.

2. The method of claim 1, wherein the converter comprises:

an input voltage converter configured to convert the AC input voltage to the predetermined DC voltage and to provide the DC driving current to the LED load, when the input voltage is the AC input voltage;

a DC voltage converter configured to convert the DC input voltage to the predetermined DC voltage when the input voltage is the DC input voltage; and an auxiliary supply configured to receive the predetermined DC voltage from the input voltage converter and provide the predetermined DC voltage to a safety circuit.

3. The method of claim 2, wherein the input voltage converter comprises a full bridge rectifier.

4. The method of claim 2, wherein the DC driving current through the LED load is directly proportional to the input voltage of the incandescent bulb emulator.

5. The method of claim 4, wherein the DC driving current through the LED load is adjusted so that the light intensity level of the LED load matches the light intensity level of an incandescent bulb to be replaced by the LED load.

6. The method of claim 5, wherein the LED load comprises a resistive load to increase the input current consumption to match the input current consumption of the incandescent bulb emulator with the input current consumption of the incandescent bulb to be replaced by the LED load across an operating voltage range.

7. The method of claim 1, wherein the controller comprises an LED driving controller having:

an open loop feedback controller configured to receive open loop feedback from the safety circuit, control the DC driving current to the LED load, and drive the LED load;

a switching circuit configured to provide switch control to the incandescent bulb emulator according to the input voltage and a failure mode of the LED load; a primary power source configured to supply DC driving current to the LED load; and the safety circuit configured to monitor the output power consumption of the incandescent bulb emulator, detect a failure mode of the LED load when the LED load fails, and send signal to the switching circuit to shut off the DC driving current to the LED load.

8. The method of claim 7, wherein the open loop feedback controller comprises a current comparator configured to compare the input current curve of the incandescent bulb emulator with the input current curve of the simulated incandescent bulb responsive to the driven LED load.

9. The method of claim 7, wherein the open loop feedback controller further comprises an electromagnetic interference (EMI) filter configured to limit the amount of power delivered to the LED load through limiting the magnetic design to match input current characteristics of the incandescent bulb.

10. The method of claim 7, wherein the safety circuit is configured to send signal to the open loop feedback controller to switch off the primary power source when the LED load is in a failure mode.

11. An incandescent bulb emulator comprising:

an LED load configured to replace an incandescent bulb;

a converter configured to receive an input voltage and convert the input voltage to a predetermined DC voltage for driving the LED load, wherein the input voltage comprises an AC input voltage and a DC input voltage;

an incandescent bulb simulator module; and a controller configured to:

compare an input current curve of the incandescent bulb emulator with an input current curve of a simulated incandescent bulb responsive to the driven LED load; and adjust a DC driving current to the LED load, based upon the comparing, such that the input current curve of the incandescent bulb emulator matches the input current curve of the simulated incandescent light bulb.

12. The incandescent bulb emulator of claim 11, wherein the converter comprises:

an input voltage converter configured to convert AC input voltage to the DC voltage and to provide the DC driving current to the LED load, when the input voltage is the AC input voltage;

a DC voltage converter configured to convert the DC input voltage to the predetermined DC voltage when the input voltage is the DC input voltage; and an auxiliary supply configured to receive the predetermined DC voltage from the input voltage converter and provide the predetermined DC voltage to a safety circuit.

13. The incandescent bulb emulator of claim 12, wherein the input voltage converter comprises a full bridge rectifier.

14. The incandescent bulb emulator of claim 12, wherein the DC driving current through the LED load is directly proportional to the input voltage of the incandescent bulb emulator.

15. The incandescent bulb emulator of claim 14, wherein the DC driving current through the LED load is adjusted so that the light intensity level of the LED load matches the light intensity level of the incandescent bulb to be replaced by the LED load.

16. The incandescent bulb emulator of claim 15, wherein the LED load comprises a resistive load to increase the input current consumption to match the input current consumption of the incandescent bulb emulator with the input current consumption of the incandescent bulb to be replaced by the LED load across an operating voltage range.

17. The incandescent bulb emulator of claim 11, wherein the controller comprises an LED driving controller having:

an open loop feedback controller configured to receive open loop feedback from the safety circuit, control the DC driving current to the LED load, and drive the LED load;

a switching circuit configured to provide switch control to the incandescent bulb emulator according to the input voltage and a failure mode of the LED load;

a primary power source configured to supply DC driving current to the LED load; and the safety circuit configured to monitor the output power consumption of the incandescent bulb emulator, detect a failure mode of the LED load when the LED load fails, and send signal to the switching circuit to shut off the DC driving current to the LED load.

18. The incandescent bulb emulator of claim 17, wherein the open loop feedback controller comprises a current comparator configured to compare the input current curve of the incandescent bulb emulator with the input current curve of the simulated incandescent bulb responsive to the driven LED load.

19. The incandescent bulb emulator of claim 17, wherein the open loop feedback controller comprises an EMI filter configured to limit the amount of power delivered to the LED load through limiting the magnetic design to match input current characteristics of the incandescent bulb.

20. The incandescent bulb emulator of claim 17, wherein the safety circuit is configured to send signal to the open loop feedback controller to switch off the primary power source when the LED load is in a failure mode.

* * * * *